US007086254B2

(12) United States Patent
Lim et al.

(10) Patent No.: US 7,086,254 B2
(45) Date of Patent: Aug. 8, 2006

(54) DIRECT-DRIVE WASHING MACHINE

(75) Inventors: Hee-Tae Lim, Incheon (KR); Dong-Won Kim, Gwangmyeong (KR); Seung-Chul Park, Gwangmyeong (KR); Bo-Yung Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 790 days.

(21) Appl. No.: 10/171,547

(22) Filed: Jun. 17, 2002

(65) Prior Publication Data

US 2003/0131636 A1 Jul. 17, 2003

(30) Foreign Application Priority Data

Jan. 17, 2002 (KR) ..... 2002-2804
Jan. 17, 2002 (KR) ..... 2002-2805

(51) Int. Cl.
*D06F 37/30* (2006.01)
*F16D 11/04* (2006.01)

(52) U.S. Cl. ..... 68/23.7; 68/133; 192/69.8

(58) Field of Classification Search ..... 68/23.6, 68/23.7, 133; 192/69.8, 71, 79, 84.6
See application file for complete search history.

(56) References Cited

U.S. PATENT DOCUMENTS 5,862,685 A * 1/1999 Lim ..... 68/23.7
6,176,108 B1 * 1/2001 Bae et al. ..... 68/23.7
6,332,343 B1 * 12/2001 Koketsu et al. ..... 68/23.7

FOREIGN PATENT DOCUMENTS

JP 11-276778 A 10/1999
KR 1998-25411 U 8/1998

* cited by examiner

*Primary Examiner*—Joseph L Perrin
(74) *Attorney, Agent, or Firm*—Birch, Stewart, Kolasch & Birch, LLP

(57) ABSTRACT

Disclosed is a direct-drive washing machine enabling to revolve a pulsator only or both of the pulsator and inner tub in accordance with a load condition such as a laundry quantity, a washing water quantity, etc, a fabric condition, and the like so as to realize an optimal washing condition as well as improve a washing efficiency. The present invention includes a first rotating shaft connected directly between the drive motor and pulsator so as to transfer a drive power of the drive motor to the pulsator directly, a second rotating shaft installed between the drive motor and inner tub separately so as to transfer the drive power of the drive motor to the inner tub selectively, a clutch installed between the second rotating shaft and drive motor so as to connect or cut off the drive power transferred from the drive motor to the inner tub, and a clutch operating device actuating the clutch.

21 Claims, 11 Drawing Sheets

DIRECT-DRIVE WASHING MACHINE

BACKGROUND OF THE INVENTION

1. Field of the Invention

The present invention relates to a direct-drive washing machine having a drive motor which drives an inner tub or pulsator directly, and more particularly, to a direct-drive washing machine enabling to drive the inner tub or pulsator selectively in accordance with a demanded condition.

2. Background of the Related Art

Generally, washing machines are divided into clutch-drive system washing machines, direct-drive system washing machines, and the like in accordance with a power transfer system. The clutch-drive system transfers a power generated from a drive motor to a pulsator using a belt, pulley, and clutch. And, the direct-drive system drives a washing vessel by connecting a drive motor directly to the washing vessel.

FIG. 1 illustrates a cross-sectional view of a direct-drive washing machine according to a related art.

Referring to FIG. 1, a direct-drive washing machine according to a related art includes a case 202 of which upper portion is open, an outer tub 206 supported by a support rod 204 inside the case 202 so as to be filled with a washing water, an inner tub 208 installed inside the outer tub 206 to revolve so as to carry out a cleaning process of a laundry, and a drive motor 212 installed under the outer tub 206 so as to drive to revolve the inner tub 208 through a tub shaft 210.

A pulsator 214 is formed in one body inside the inner tub 208 so as to generate a washing current.

The direct-drive washing machine according to the related art comes into cleaning the laundry as the drive motor 212 is driven to revolve the inner tub 208 having the pulsator 214 formed in one body to generate a frictional power with the laundry.

Yet, in the direct-drive washing machine according to the related art, the inner tub 208 revolves regardless of a species and quantity of the laundry and a washing water quantity so as to carry out the washing process, whereby the laundry of small quantity comes into revolution in the same direction of the inner tub. In this case, the frictional power is hardly generated so as to reduce a washing power of the laundry.

Moreover, the above-constituted direct-drive washing machine according to the related art is constituted so as to carry out the washing process by revolving the inner tub 208. Compared to the system of carrying out the washing process by revolving the pulsator 214 only, such a direct-drive washing machine according to the related art has an increasing inertia to increase a load of the drive motor 212 so as to degrade a drive efficiency.

Furthermore, in order to operate freely the drive motor 21 for speed, torque, slope, and the like, the above-explained direct-drive washing machine according to the related art uses a BLDC(brushless DC) motor requiring an additional controller to be controlled, whereby a cost is increased.

SUMMARY OF THE INVENTION

Accordingly, the present invention is directed to a direct-drive washing machine that substantially obviates one or more problems due to limitations and disadvantages of the related art.

An object of the present invention is to provide a direct-drive washing machine enabling to revolve a pulsator only or both of the pulsator and inner tub in accordance with a load condition such as a laundry quantity, a washing water quantity, etc, a fabric condition, and the like so as to realize an optimal washing condition as well as improve a washing efficiency.

Another object of the present invention is to provide a direct-drive washing machine revolves a pulsator only in accordance with the necessity of a drive motor so as to maximize an energy efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a direct-drive washing machine according to the present invention includes an outer tub placed inside a case so as to keep a washing water in store, an inner tub installed inside the outer tub to revolve wherein that a cleaning of a laundry is carried out in the inner tub, a pulsator installed inside the inner tub so as to revolve relatively to the inner tub, a drive motor installed under the outer tub so as to revolve the pulsator and inner tub, a first rotating shaft connected directly between the drive motor and pulsator so as to transfer a drive power of the drive motor to the pulsator directly, a second rotating shaft installed between the drive motor and inner tub separately so as to transfer the drive power of the drive motor to the inner tub selectively, a clutch installed between the second rotating shaft and drive motor so as to connect or cut off the drive power transferred from the drive motor to the inner tub, and a clutch operating device actuating the clutch.

Preferably, an inner tub shaft having a cylindrical shape is connected to a lower side of the inner tub so as to revolve the inner tub, wherein the inner tub shaft is connected to the first rotating shaft, wherein a pulsator shaft is connected to a lower end of the pulsator so as to revolve the pulsator, and wherein the pulsator shaft is inserted inside the inner tub shaft to rotate relatively so as to be connected to the first rotating shaft.

Preferably, the drive motor is an outer rotor type motor so that a rotor is installed outside a stator and wherein the rotor is connected to a rotor housing transferring a turning force.

More preferably, a connecting device is installed between an upper side of the first rotating shaft and the pulsator shaft so as to transfer a turning force of the first rotating shaft to the pulsator shaft.

More preferably, the second rotating shaft has a cylindrical figure in which the first rotating shaft is inserted to rotate relatively, an upper end of the second rotating shaft is connected to the inner tub shaft through the connecting device, and gear teeth are formed at a lower end of the second rotating shaft in a circumferential direction.

More preferably, the connecting device includes a housing connected between the upper end of the second rotating shaft and a lower end of the inner tub shaft and having gear teeth of the housing in a direction of an inner circumference face, a planetary gear gearing with the gear teeth of the housing and gear teeth formed at an upper side of the first rotating shaft so as to rotate and revolve, a hub to which an upper end of a hinge shaft supporting the planetary gear to rotate is fixed wherein the pulsator shaft is fixed to a central upper side of the hub, and a support plate supporting a lower end of the hinge shaft.

More preferably, the clutch includes a rotor bushing fixed in a circumferential direction of the rotor housing to revolve together with the rotor housing and having gear teeth at an outer circumference face, a sleeve gearing between the gear teeth of the rotor bushing and the gear teeth of the second rotating shaft so as to move upward and downward in accordance with operation of the clutch operating device to connect the rotor bushing to the second rotating shaft or cutting off the rotor bushing from the second rotating shaft, and a locking means for locking the sleeve not to revolve when the sleeve moves upward, the locking means formed at an upper side of the sleeve.

More preferably, the locking means includes a plurality of locking lugs formed at an upper face of the sleeve in a circumferential direction and a locking bracket having a plurality of locking recesses in which the locking lugs are inserted respectively and fixed to a fixed side of the washing machine.

More preferably, a first spring is installed between an inner lateral face of the sleeve and one side of the second rotating shaft so as to return the sleeve to an original state.

More preferably, the first spring is a compressive coil spring.

More preferably, the clutch operating device includes an operating lever arranged at an outer circumference face of the sleeve so as to slip wherein one side of the operating lever is hinge-connected to a fixed side of the case so as to move the sleeve upward and downward and an actuator connected to the other end of the operating lever so as to revolve the operating lever.

More preferably, the operating lever has a vertically bent plate shape, and wherein the operating lever comprises a folk portion at an end of a lower side so as to be inserted in the outer circumference face of the sleeve by sliding, a hinge protrusion at a bent portion so as to be hinge-connected to a fixed side of the outer tub, and a connecting pin at an end of an upper side so as to be connected to the actuator.

More preferably, a second spring is installed between the inner lateral face of the operating lever and the fixed side of the case so as to return the operating lever to an original state.

More preferably, the second spring is a tension coil spring.

More preferably, a buffer device is installed between the operating lever and connecting pin of the actuator so as to prevent the operating lever from deflection caused by a drive power of the actuator when the sleeve moves upward so that the locking lugs fail to be inserted precisely in the locking recesses.

More preferably, the buffer device includes a cylinder connected to the connecting pin of the operating lever and having an opening at one side, a piston inserted in the cylinder so as to move straight and connected to the actuator, a cap loaded on the opening of the cylinder, and a third spring installed between the cap and cylinder so as to give a predetermined elastic power when the cylinder moves straight.

More preferably, a value of the elastic power the third spring is greater than a total value of elastic powers of the first and second springs and smaller than the drive power of the actuator.

More preferably, the third spring is a compressive coil spring.

More preferably, the actuator is a motor.

Preferably, the clutch operating device includes an operating lever inserted in an outer circumference face of the sleeve to slip wherein one side of the operating lever is hinge-connected to a fixed side of the case, a wire connected to the other side of the operating lever, a pulley on which the wire is wound, and an actuator revolving the pulley.

More preferably, the operating lever includes a hinge connecting part at one side so as to be connected to the fixed side of the case to revolve, a lifting part at a central portion so as to be inserted in the outer circumference face of the sleeve to move the sleeve upward and downward, and a wire connecting part at the other side so as to be connected to the wire.

More preferably, a plurality of contact protrusions are formed at an upper face of the lifting part of the operating lever so as to minimize a contact area with the sleeve.

More preferably, the wire connecting part extends from the lifting part to a predetermined length and is inclined in a direction of a lower side at a predetermined angle.

More preferably, a reducer is installed between the drive motor and pulley so as to reduce the drive power generated from the drive motor.

Preferably, the direct-drive washing machine further includes a brake assembly installed at an other circumference of the housing of the connecting device so as to brake the inner tub.

More preferably, the brake assembly includes a brake lever connected to a drain motor so as to operate in accordance with operation of the drain motor and a brake band connected to the brake lever so as to be wrapped by an outer circumference face of the housing of the connecting device.

More preferably, the drain motor is a motor operating by first and second steps, wherein a braking of the brake assembly is released when the drain motor operates by the first step, and wherein a drain valve is actuated as well as the braking of the brake assembly is released when the drain motor operates by the second step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
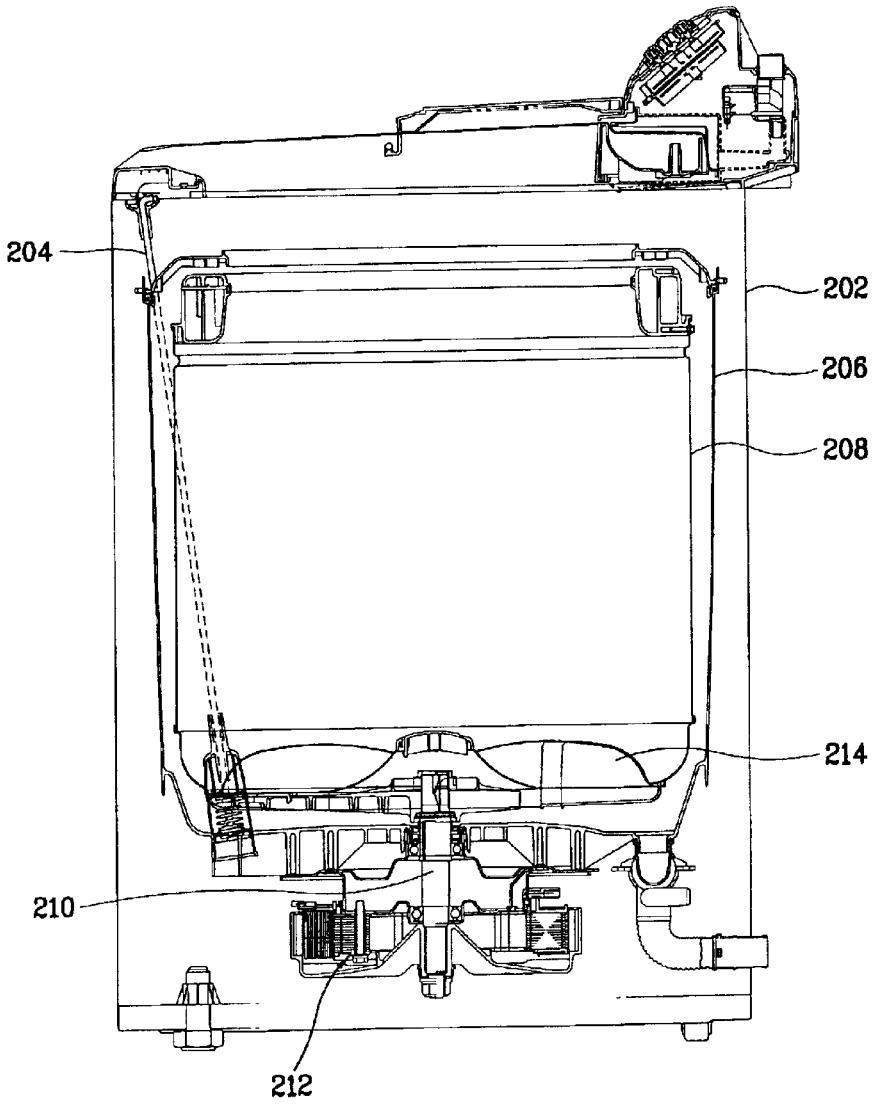
FIG. 1 CONVENTIONAL ART
FIG. 1 illustrates a cross-sectional view of a direct-drive washing machine according to a related art.
Figure 2:
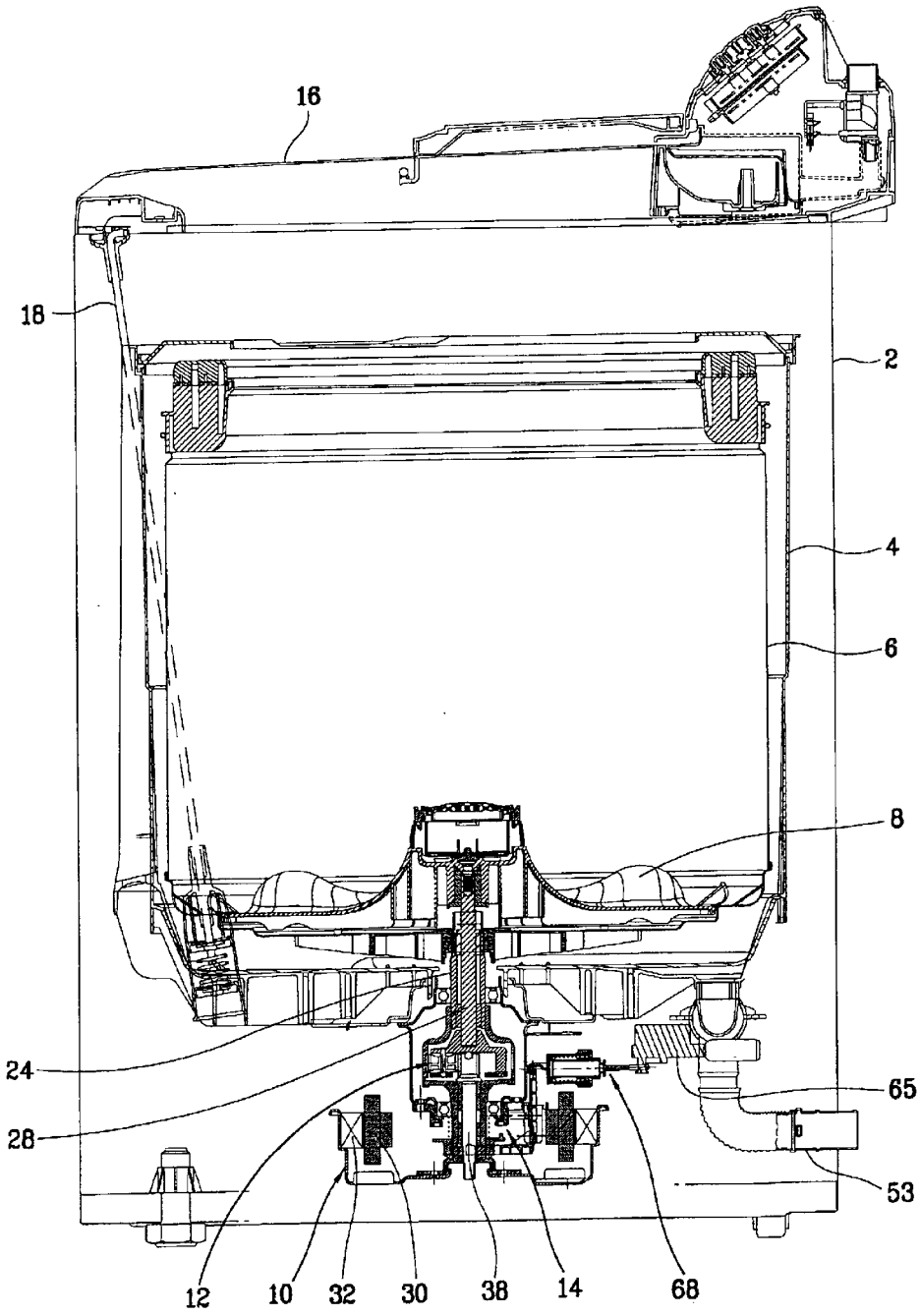
FIG. 2 illustrates a cross-sectional view of a direct-drive washing machine according to a first embodiment of the present invention.
Figure 3:
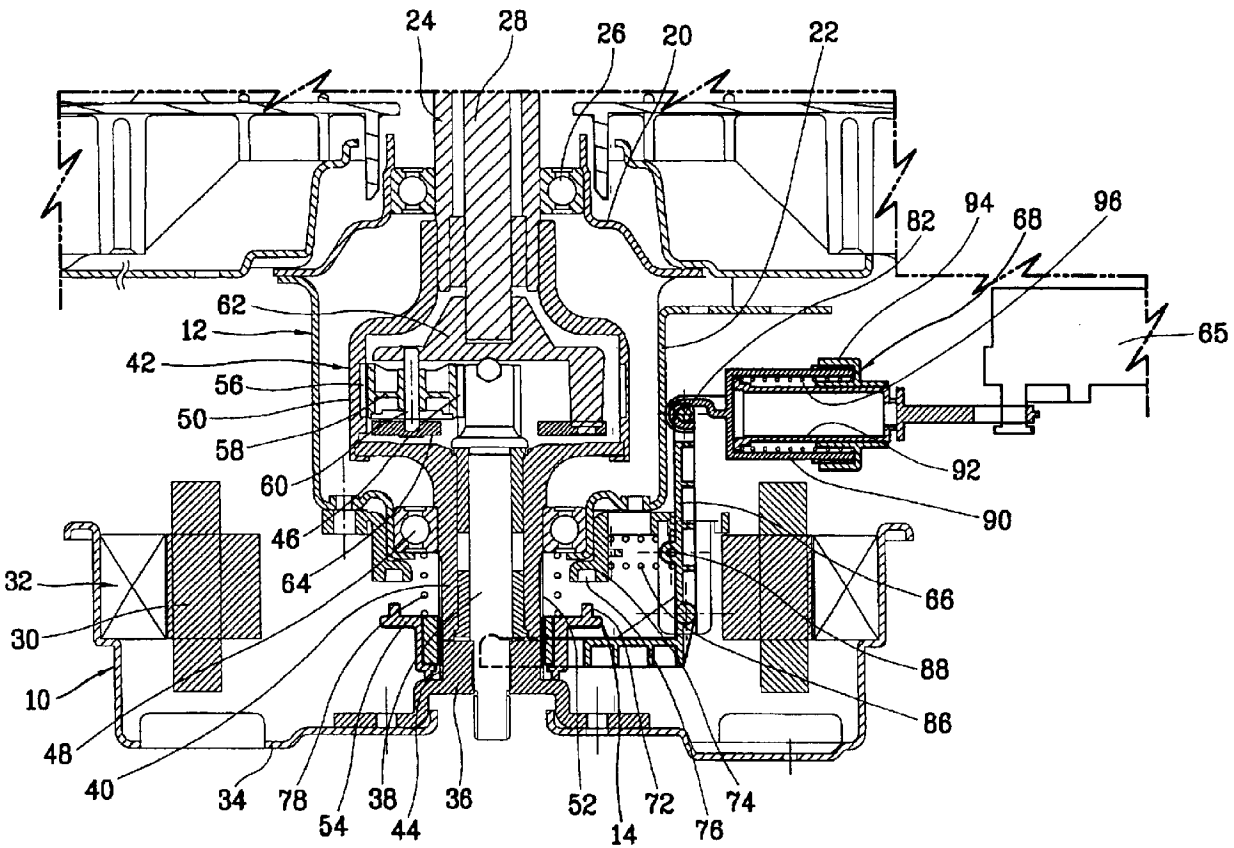
FIG. 3 illustrates a magnified cross-sectional view of a major component in FIG. 2.
Figure 4:
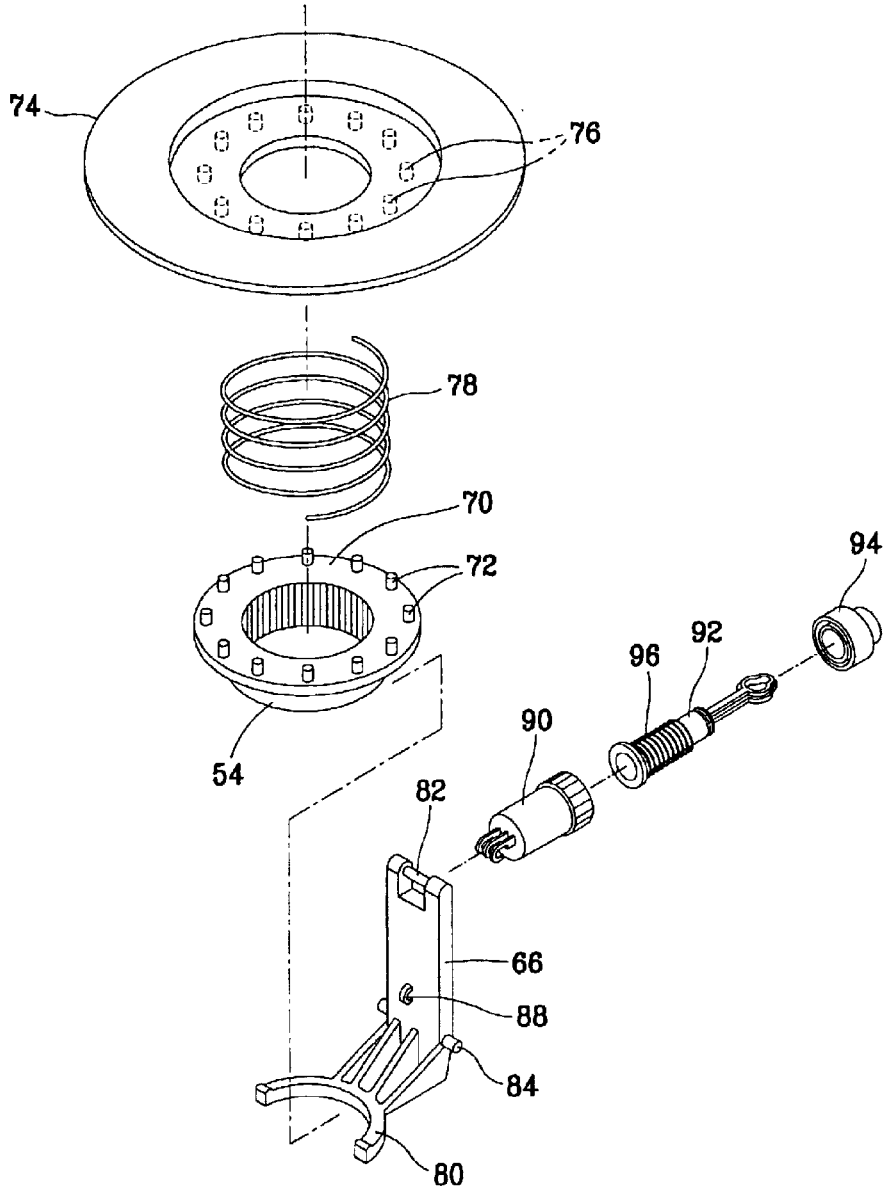
FIG. 4 illustrates a bird's-eye view of a disassembled major component in FIG. 3.

FIG. 2 illustrates a cross-sectional view of a direct-drive washing machine according to a first embodiment of the present invention, FIG. 3 illustrates a magnified cross-sectional view of a major component in FIG. 2, and FIG. 4 illustrates a bird's-eye view of a disassembled major component in FIG. 3.

Referring to FIG. 2, a direct-drive washing machine according to a first embodiment of the present invention includes a case 2 of which upper portion is open, an outer tub 4 supported by an inner side of the case 2 so as to keep a washing water in store, an inner tub 6 installed inside the outer tub 4 to revolve so as to carry out a cleaning process of a laundry, a pulsator 8 installed inside the inner tub 6 to revolve relatively to the inner tub 6 so as to form a washing current, a drive motor 10 installed under the outer tub 4 so as to generate a turning force enabling to revolve the pulsator 8 and inner tub 6, a power transmission unit 12 connected between the drive motor 10 and the pulsator 8 and inner tub 6 so as to transfer the turning force of the drive motor 10 to the pulsator 8 and the inner tub 6 selectively, and a clutch device 14 transferring or cutting off a driving force generated from the drive motor 10 to the inner tub 6.

The upper portion of the case 2, as shown in FIG. 2, is open so as to keep the laundry in store. A cover 16 is installed over the open portion of the case 2 so as to be closed/opened. And, support rods 18 are installed inside the case 2 so as to support the outer tub 4 for enabling a damping thereof.

The inner tub 6 is installed inside the outer tub 4 for enabling a revolution thereof. The pulsator 8 is installed at an inner bottom area of the inner tub 6 so as to be coupled for enabling the relative revolution against the inner tub 6. And, a drain pipe 53 is formed at the bottom of the outer tub 4 so as to discharge the washing water filling the outer tub 4.

An upper bearing housing 20 having a disk figure is coupled with a bottom of the outer tub 4, and a lower bearing housing 22 is coupled with a bottom of the upper bearing housing 20.

An inner tub shaft 24 is connected to a lower part of the inner tub 6 so as to revolve the inner tub 6. The inner tub shaft 24 is cylindrical so as to have a space at a central part in a length direction as well we be supported to revolve by an upper bearing 26 loaded between the upper bearing housing 20 and the inner tub shaft.

A pulsator shaft 28 is connected to a lower part of the pulsator 8 so as to revolve the pulsator 8. The pulsator 28 is inserted in an inner circumference face of the inner tub shaft 24 so as to revolve.

In this case, an oil-less type bearing(not shown in the drawing) is installed between the inner circumference face of the inner tub shaft 24 and an outer circumference face of the pulsator shaft 28 so as to support both of the sides to move relatively.

The drive motor 10 is a general induction motor, BLDC (brushless DC motor), or the like, and an outer rotor type motor is preferably applied to the embodiment of the present invention. Namely, a stator 30 is located inside, and a rotor 32 is located outside. The rotor 32 is connected to the power transmission unit 12 by a rotor housing 34. Once a power is applied to the drive motor 10, a turning force of the rotor 32 is transferred to the power transmission unit 12 through the rotor housing 34.

The power transmission unit 12 includes a rotor bushing 36 coupled with an inner circumference face of the rotor housing 34 so as to revolve together with the rotor housing 34, a first rotating shaft 38 coupled with the rotor bushing 36 by spline and connected to the pulsator shaft 28, and a second rotating shaft 40 arranged at an outer circumference face of the first rotating shaft 38 to rotate relatively and connected to the inner tub shaft 24 so as to transfer the turning force of the rotor bushing 36 to the inner tub shaft 24 selectively in accordance with an operation of the clutch device 14 wherein a lower part of the second rotating shaft 40 is arranged to confront the rotor bushing 36.

In this case, a connecting device 42 is installed between the pulsator shaft 28 and first rotating shaft 38 so as to transfer the turning force of the first rotating shaft 38 to the pulsator shaft 28.

A central part of the rotor bushing 36 is coupled with the first rotating shaft 38 so that the rotor bushing 36 rotates together with the first rotating shaft 38. A lower part of the rotor bushing 36 is coupled with the rotor housing 34 by bolt. And, gear teeth 44 are formed at an outer circumference face of the rotor bushing 36.

A lower part of the first rotating shaft 38 is coupled with the rotor bushing 36 by spline, and another gear teeth 46 are formed at an upper outer circumference face of the first rotating shaft 38 so as to be geared with one component of the connecting device 42, The second rotating shaft 40 is cylindrical, and installed adjacent to the lower bearing housing 22 to be supported revolvably. An inner diameter of an upper side of the second rotating shaft 40 increases so as to be fixed to a housing 50 of the connecting device 42, and the other gear teeth 52 are formed at a lower outer circumference face of the second rotating shaft 40 so as have the same size of the gear teeth 44 formed at the rotor bushing 36.

A sleeve 54 is inserted between the gear teeth 53 of the second rotating shaft 40 and the gear teeth 44 of the rotor bushing 36 so as to slide to move. The sleeve 54 slides between the gear teeth 44 and 52 by operation of the clutch device 14 so as to transfer or cut off the turning force of the rotor bushing 36 to the second rotating shaft 40.

The connecting device 42 includes a housing 50 connected between an upper end of the rotating shaft 40 and a lower end of the inner tub shaft 24 so as to have gear teeth 56 in a direction of an inner circumference face, a planetary gear 58 gearing between the gear teeth 56 of the housing 50 and the gear teeth 46 of the first rotating shaft 38 so as to rotate and revolve, a hub 62 wherein an upper end of a hinge shaft 60 supporting the planetary gear 58 to rotate is fixed eccentrically to one side of the hub 62 and wherein the pulsator shaft 28 is fixed to an upper center of the hub 62, and a support plate 64 supporting a lower end of the hinge shaft 60.

Namely, when the first rotating shaft 38 rotates, the planetary gear 58 revolves and rotates in a circumferential direction of the first rotating shaft 38 so as to rotate the hub 62. And, the pulsator shaft 28 fixed to an upper side of the hub 62 rotates to revolve the pulsator 8 so as to carry out a cleaning process.

When the first and second rotating shafts 38 and 40 rotate together, the housing 50 and planetary gear 58 rotate in one body so as to rotate the inner tub shaft 24 and pulsator shaft 28 simultaneously.

The clutch device 14, as shown in FIG. 4, includes a sleeve 54 sliding to move between the gear teeth 44 of the rotor bushing 36 and the gear teeth 52 of the second rotating shaft 40 and a locking means formed at an upper side of the sleeve 54 so as to lock the inner tub. And, the sleeve 54 moves up and down by a clutch operating device.

In this case, the sleeve 54 is cylindrical. An inner circumference face of the sleeve 54 gears with the gear teeth 44 and 52 of the rotor bushing 36 and second rotating shaft 40. The sleeve 54 has a flange part 50 of which upper side extends in a circumferential direction. A plurality of locking lugs 72 are formed in a circumferential direction at an upper face of the flange part 70 so as to leave a predetermined interval each. And, a locking bracket 74 is arranged at an upper side of the sleeve 54. The locking lugs 72 are inserted into the locking bracket 74 when the sleeve 54 ascends so as to lock a revolution of the sleeve 54.

The locking bracket 74 has a disk shape having a predetermined step difference. An upper circumference face of the locking bracket 74 is coupled with the lower bearing housing 22 by bolt. And, a plurality of locking recesses 76 are formed in a circumferential direction at a lower side of the locking bracket 74 so that the locking lugs 72 are inserted into the locking recesses 76.

A first spring 78 is installed between an upper face of the sleeve 54 and a lower face of the locking bracket 74 so as to give the sleeve 54 an elastic power working downward. In this case, the first spring 78 is preferably a compressive coil spring.

The clutch operating device, as shown in FIG. 4, includes an operating lever 66 slipping in an outer circumference face of the sleeve 54 so as to lift upward and downward the sleeve 54 wherein one side of the operating lever 66 is hinge-connected, an actuator 65 connected to an end of the operating lever 66 so as to move the operating lever 66, and a buffer device 68 connected between the operating lever 66 and actuator 65 so as to prevent deflection and damage of the operating lever 66.

The operating lever 66 is has a plate shape bent vertically. A fork part 80 is formed at a lower end of the operating lever 66 so as to be slipped into the outer circumference face of the sleeve 54 to move the revolving sleeve 54 upward and downward. A connecting pin 82 to which one side of the buffer device is connected is formed at an upper end of the operating lever 66. Hinge protrusions 84 protrude from both sides of the bent portion of the operating lever 66 so as to support the operating lever 66 to revolve. And, a second spring 86 is connected between an inner face of the operating lever 66 and one side of the locking bracket 74 so as to give the operating lever 66 an elastic power to return to its original state after the operation of the operating lever 66.

In this case, the second spring 68 is preferably a tension coil spring, and a connecting link 88 is formed in one body at the inner face of the operating lever 66 so as to be connected to one end of the second spring 86.

The buffer device 68 includes a cylinder 90 connected to the connecting pin 82 of the operating lever 66 and having a cylindrical figure of which one side is open, a piston 92 inserted inside the cylinder 90 to move straight and connected to the actuator 65, a cap 94 loaded on an opening of the cylinder 90, and a third spring 96 wound on an outer circumference of the piston wherein one end of the third spring 96 is arranged at a front side of the piston 92 and wherein the other end of the third spring 96 is arranged at an inner face of the cap 94.

In this case, an elastic power of the third spring 96 is formed to have a value greater than a total value of the elastic powers of the first and second springs 78 and 86 so that the elastic power fails to work when the operating lever 66 revolves. Besides, in case that a precise insertion fails to occur when the sleeve 54 ascends so that the locking lugs 72 are inserted into the locking recesses 76, the operating lever 66 is metamorphosed by a pulling force of the actuator 65. At this moment, the third spring 96 is compressed so as to prevent the metamorphosis of the operating lever 66.

Figure 5:
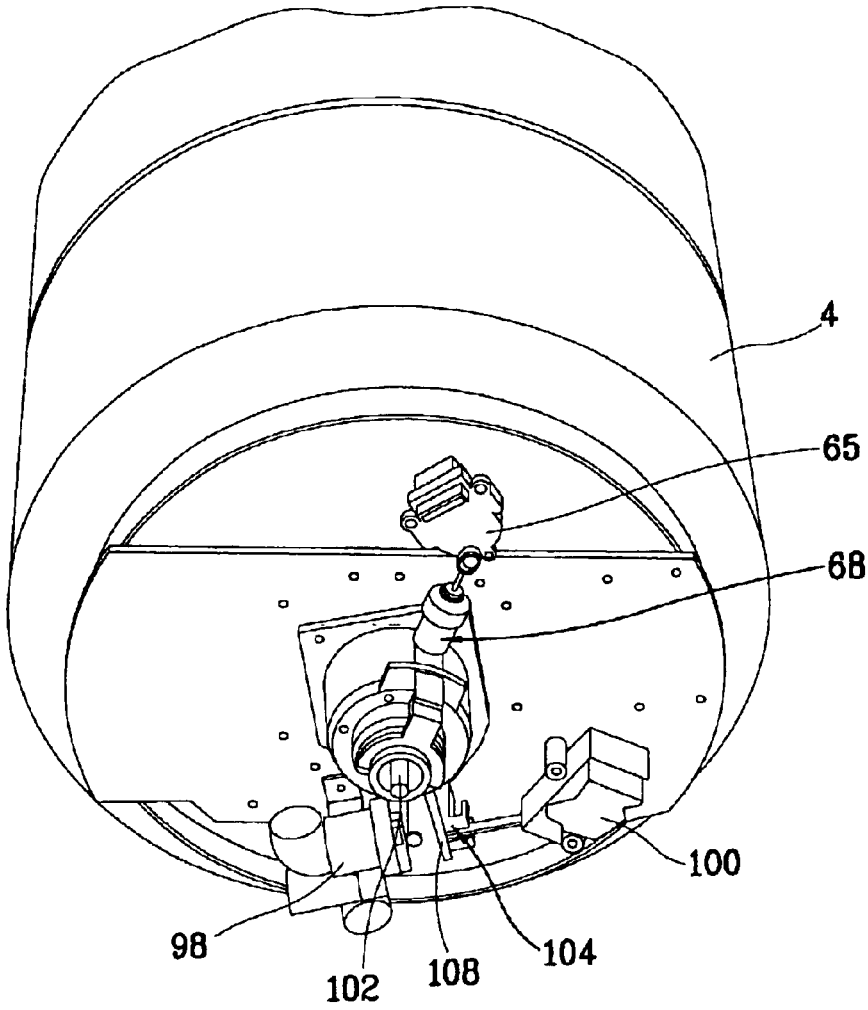
FIG. 5 illustrates a bird's-eye view of a bottom of an outer tube of the direct-drive washing machine in part according to the first embodiment of the present invention.

FIG. 5 illustrates a bird's-eye view of a bottom of an outer tube of the direct-drive washing machine in part according to the first embodiment of the present invention.

Referring to FIG. 5, a drain valve 98 is installed at one side of a drain pipe 53 draining a washing water, which fills an inside of the outer tub 4, on an outer bottom face of the outer tub 4 so as to open/close the drain pipe 53. A drain motor 100 is installed at one side of the outer tub 4 so as to actuate the drain valve 98. And, a brake assembly 104 is installed at the housing 50 of the connecting device 42 connected to the inner tub shaft 24.

The brake assembly 104 is a drum brake type, and includes a brake lever 108 connected to the drain motor 100 so as to operate in accordance with a revolution of the drain motor 100 and a brake band(not shown in the drawing) connected to the brake lever 108 and wrapped by the housing 50 of the connecting device 42.

The drain motor 100 operates by first and second steps. Working at the first step, the drain motor 100 releases a braking of the brake assembly 104. Working at the second step, the drain motor 100 actuates the drain valve 98 as well as releases the braking of the brake assembly 104.

Likewise, when a power is not applied to the drain motor 100, the inner tub is braked by the brake assembly 104. When the drain motor 100 is operated by the first step, the brake is released so that the inner tub 6 enables to revolve. When the drain motor 100 is operated by the second step, the drain valve 98 is opened so as to drain the washing water filling the outer tub 4 as well as release the brake assembly 104.

Operation of the above-constituted direct-drive washing machine according to the present invention is explained as follows.

Figure 6:
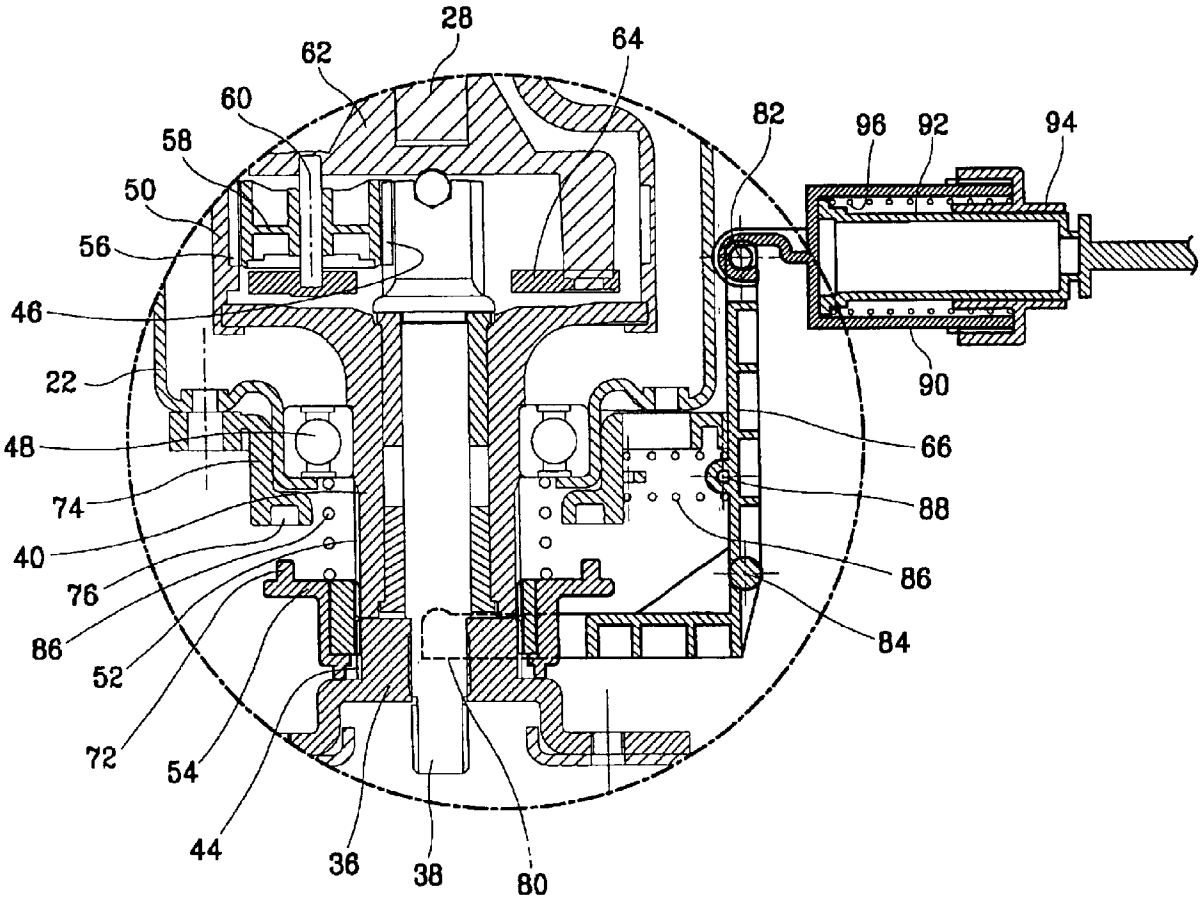
FIG. 6 and FIG. 7 illustrate cross-sectional views for showing operational states of the direct-drive washing machine according to the first embodiment of the present invention.
Figure 7:
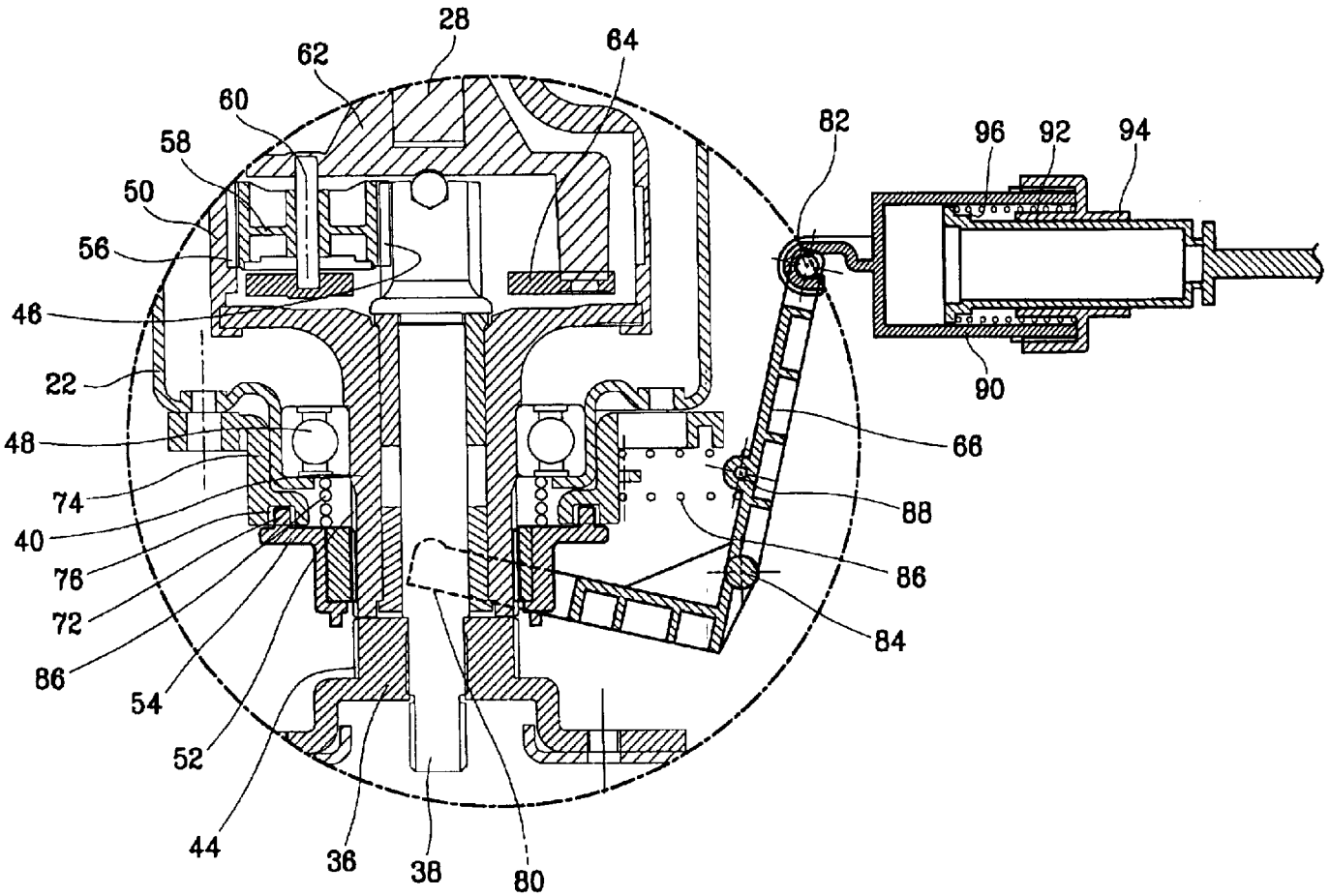

FIG. 6 and FIG. 7 illustrate cross-sectional views for showing operational states of the direct-drive washing machine according to the first embodiment of the present invention.

First, a water supply operation of the washing machine is explained in the following.

For the water supply of the washing machine, the inside of the outer tub 4 is supplied with the washing water while the drive motor 10, actuator 65, and drain motor 100 are turned off.

Namely, if the actuator 65 is turned off, the sleeve 54 descends by a tensile elastic force of the first spring 78, a compressive elastic force, and its own weight of the second spring 86 so as to gear with the gear teeth 52 and 44 of the second rotating shaft 40 and rotor bushing 36. When the drain motor 100 is turned off so that the drain valve 98 and the brake assembly 104 are closed and actuated, respectively, the drain pipe 53 and the inner tub 6 are closed and locked, respectively.

After the completion of the water supply operation, a washing operation is carried out.

On the washing operation, it is selected whether the pulsator 8 is revolved only or both of the pulsator 8 and inner tub 6 are revolved under washing conditions such as laundry contamination, laundry quantity, laundry state, and the like.

In this case, if the laundry contamination is severe and the laundry quantity is overloaded, the pulsator 8 is revolved only, of which explanation follows in detail.

When the pulsator 8 is revolved only, the drive motor 10 and actuator are turned on while the drain motor 100 is turned off. Once the drive motor 10 is turned on, the rotor 32 starts to revolve by the interaction between the rotor 32 and stator 30. And, the rotor housing 34 fixed to the rotor 32 revolves to revolve the rotor bushing 36 connected to the rotor housing 34. Then, the first rotating shaft 38 coupled with the rotor bushing 36 by spline rotates so as to rotate the pulsator shaft 28 connected to the first rotating shaft 38 through the connecting device rotates. Hence, the pulsator 8 is revolved so as to carry out a cleaning process.

As the actuator 65 is turned on so that the clutch device 14 is actuated to push the sleeve 54 upward, the connection between the rotor bushing 36 and second rotating shaft 40 is cut off as well as the second rotating shaft 40 becomes locked. Therefore, the inner tub 6 maintains a still state. Since the drain motor 100 is turned off, the brake of the brake assembly 104 is actuated to maintain the still state of the inner tub 6.

Operation of the connection device 64 is as follows. As the first rotating shaft 38 comes into revolution, the planetary gear 58 gearing between the gear teeth 46 and 56 of the first rotating shaft 38 and housing 50 starts to rotate and revolve along the outer circumference face of the first rotating shaft 38. In this case, the housing 56 is held still in accordance with the actuation of the clutch device 14, and the hub 62 to which the upper end of the hinge shaft 60 of the planetary gear 58 is fixed starts to revolve. Then, the pulsator shaft 28 fixed to the hub 62 rotates so as to revolve the pulsator 8.

Operation of the clutch device 14 is as follows. As the actuator 65 is driven, the buffer device 68 is moved entirely. And, the operating lever 66 connected to the buffer device 68 rotates centering around the hinge protrusions 84. The folk part 80 of the operating lever 66 then moves upward so as to push the sleeve 54 upward.

As the sleeve 54 moves upward so as to be separated from the gear teeth 44 of the rotor bushing 36, the power transmission from the rotor bushing 36 to the second rotating shaft 40 is cut off. And, the locking lugs 72 formed at the upper face of the sleeve 54 are inserted into the locking recesses 76 at the lower face of the locking bracket 74 so as to lock the second rotating shaft 40. The inner tub shaft 24 connected to the second rotating shaft 40 through the housing 56 then becomes still and the inner tub 6 connected to the inner tub shaft 24 is held still.

In this case, since the first spring 78 connected between the operating lever 66 and locking bracket 74 and the second spring 86 installed at the upper face of the sleeve 54 have elastic powers smaller than an operational power of the actuator, the first spring becomes pulled while the second spring 86 is compressed.

During the above-explained operation, when the locking lugs 72 of the sleeve 54 fail to be inserted precisely in the locking recesses 76 of the locking bracket 74, the buffer device 68 cancels out a pulling force of the actuator 65 so as to prevent the deflection or damage of the operating lever 66. Namely, when the locking lugs 72 fail to be inserted precisely into the locking recesses 76, the third spring 96 is compressed so that the piston 92 moves straight inside the cylinder 90. Therefore, the operating lever 66 is prevented from being affected by the operational power of the actuator 65. In this case, the elastic power of the third spring 96 is set up as being smaller than the operational power of the actuator 65 and greater than the total value of the elastic powers of the first and second springs 76 and 86.

Next, when the laundry contamination is low, the laundry quantity is excessive, or the laundry is made of weak fabric, the pulsator 8 and inner tub 6 are revolved simultaneously. In this case, the drive motor 10 is turned on, the actuator 65 is turned off, and the drain motor 100 is driven by the first step.

Operation of revolving the pulsator 8 and inner tub 6 simultaneously is explained as follows.

The drive power of the drive motor, as mentioned in the above description, is transferred to the pulsator 8 so as to revolve the pulsator 8.

As the actuator 65 becomes turned off so that the sleeve 54 moves downward, the inner tub 6 becomes connected to the rotor bushing 36 and second rotating shaft 40 through the sleeve 54. Then, the second rotating shaft 40 rotates to rotate the inner tub shaft 24 so as to revolve the inner tub 6.

Specifically, when the actuator 65 becomes turned off, the operating lever 66 returns to its original state by the compression power of the second spring 78. When the sleeve 54 moves downward by the tensile strength of the first spring 86, the locking hugs 72 of the sleeve 54 become separated from the locking recesses 76 of the locking bracket 74 so as to unlock the second rotating shaft 40. The sleeve 54 then gears between the gear teeth 44 of the rotor bushing 36 and the gear teeth of the second rotating shaft 40 together so as to transfer the turning force of the rotor bushing 36 to the second rotating shaft 40. As the housing comes into revolution in accordance with the rotation of the second rotating shaft 40, the inner tub shaft 24 rotates so as to revolve the inner tub 6.

And, when the drain motor 100 is driven by the first step, the brake assembly 104 is actuated in a direction of releasing the brake so as to release the brake of the housing 50 of the connecting device 42. In this case, the drain valve 98 maintains the 'turned-off' state.

After the completion of the washing process of the washing machine, a dehydration process of discharging the washing water externally is carried out. During the dehydration process, the drive motor 10 is turned on, the actuator 65 is turned off, and the drain motor 100 is driven by the second step.

Namely, once the drive motor 10 and actuator 65 are turned on and off, respectively, the pulsator 8 and inner tub 6 are revolved simultaneously by the same operation explained in the above description. When the drain motor 100 is driven by the second step, the brake assembly 104 maintains the "turned-on" state as well as the drain valve 98 is actuated to open the drain pipe 53 connected to the outer tub 4 so as to discharge the washing water filling the outer tub 4 externally.

Figure 8:
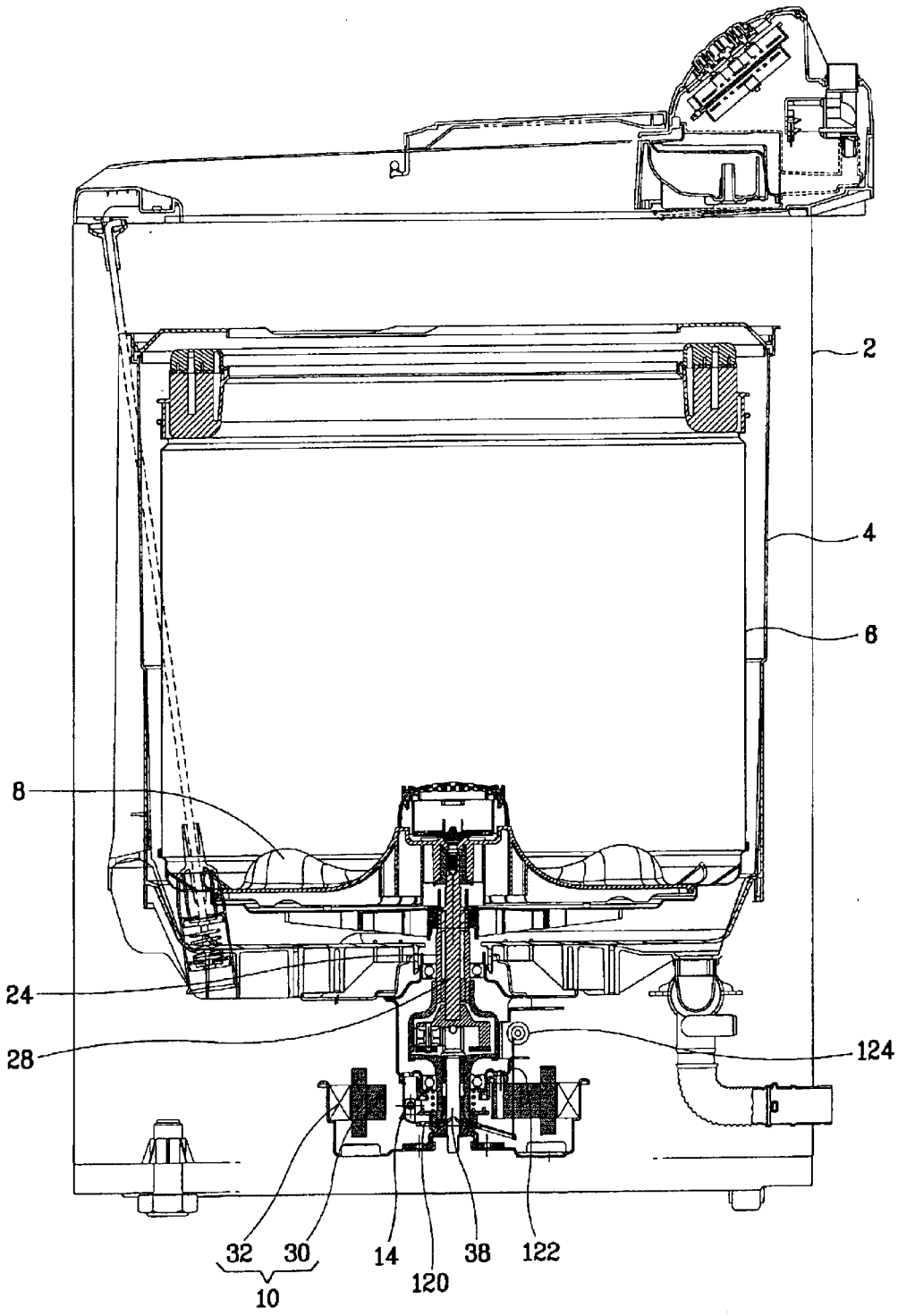
FIG. 8 illustrates a cross-sectional view of a direct-drive washing machine according to a second embodiment of the present invention.
Figure 9:
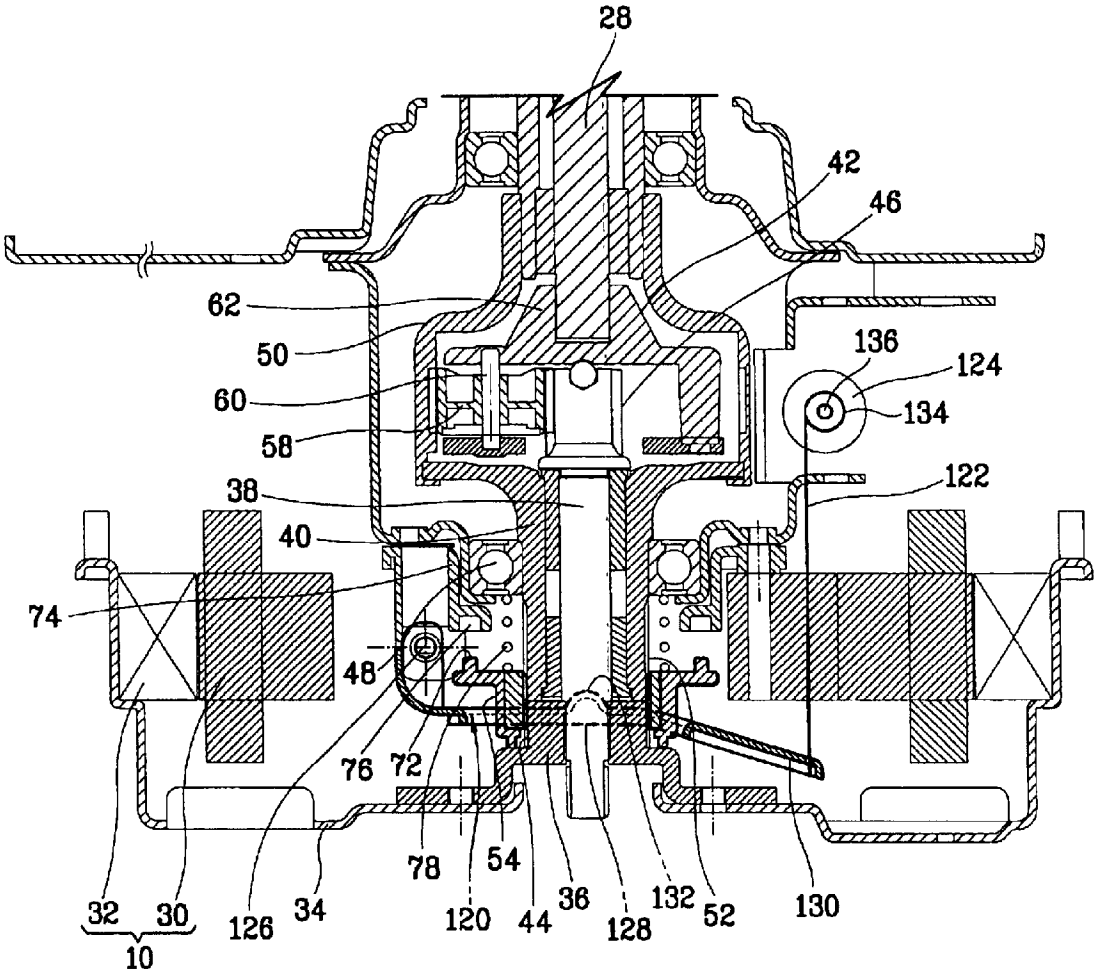
FIG. 9 illustrates a magnified cross-sectional view of a major component in FIG. 8.

FIG. 8 illustrates a cross-sectional view of a direct-drive washing machine according to a second embodiment of the present invention, and FIG. 9 illustrates a magnified cross-sectional view of a major component in FIG. 8.

A direct-drive washing machine according to a second embodiment of the present invention simplifies the structure of the clutch operating device operating the clutch of the above-described direct-drive washing machine according to the first embodiment of the present invention. Hence, the constitutions of the rest components except the clutch operating device according to the second embodiment of the present invention are the same of the first embodiment of the present invention, of which explanation is skipped.

A clutch operating device according to the second embodiment of the present invention includes am operating lever 120 inserted to slip in an outer circumference face of the sleeve 54 so as to move the sleeve 54 upward wherein one end of the operating lever 120 is hinge-connected to a fixed side of the outer tub 4, a wire 122 connected to the other end of the operating lever 120 so as to revolve the operating lever 120, and an actuator 124 connected to the other end of the wire 122 so as to pull the wire 122.

A hinge hole 126 is formed at one end of the operating lever 120 so that a hinge pin(not shown in the drawing) protruding from one side of the locking bracket 74 locking the sleeve 54 is inserted in the hinge hole 126 to revolve. A lifting part 128 having a circular shape is formed at a central side of the operating lever 120 so as to slip to be inserted in an outer circumference face of the sleeve 54 to lift upward and downward the sleeve 54. And, a wire connecting part 130 is formed at the other end of the operating lever 120 so as to be connected to the wire 122.

A plurality of contact protrusions 132 protrude from an upper end of a circumference face of the lifting part 128, whereby a contact area of the sleeve 54 is minimizes so as not to interrupt the revolution of the sleeve 54.

The wire connecting part 130 is formed to be inclined at a predetermined angle downward so as not to interrupt the movement of the lifting part 128 in accordance with the revolution of the operating lever 120.

One end of the wire 12 is connected to the wire connecting part 130, while the other end of the wire 122 is wound on a pulley 134. In this case, the pulley 134 is loaded on a rotating shaft 136. Besides, a reducer(not shown in the drawing) may be loaded between the pulley 134 and the rotating shaft 136 of the actuator 124 so as to reduce a turning power of the actuator 124.

In this case, the actuator 124 preferably uses a motor generating a revolution-driving force with ease.

Operation of the above-constituted direct-drive washing machine according to the second embodiment of the present invention is explained as follows.

Figure 10:
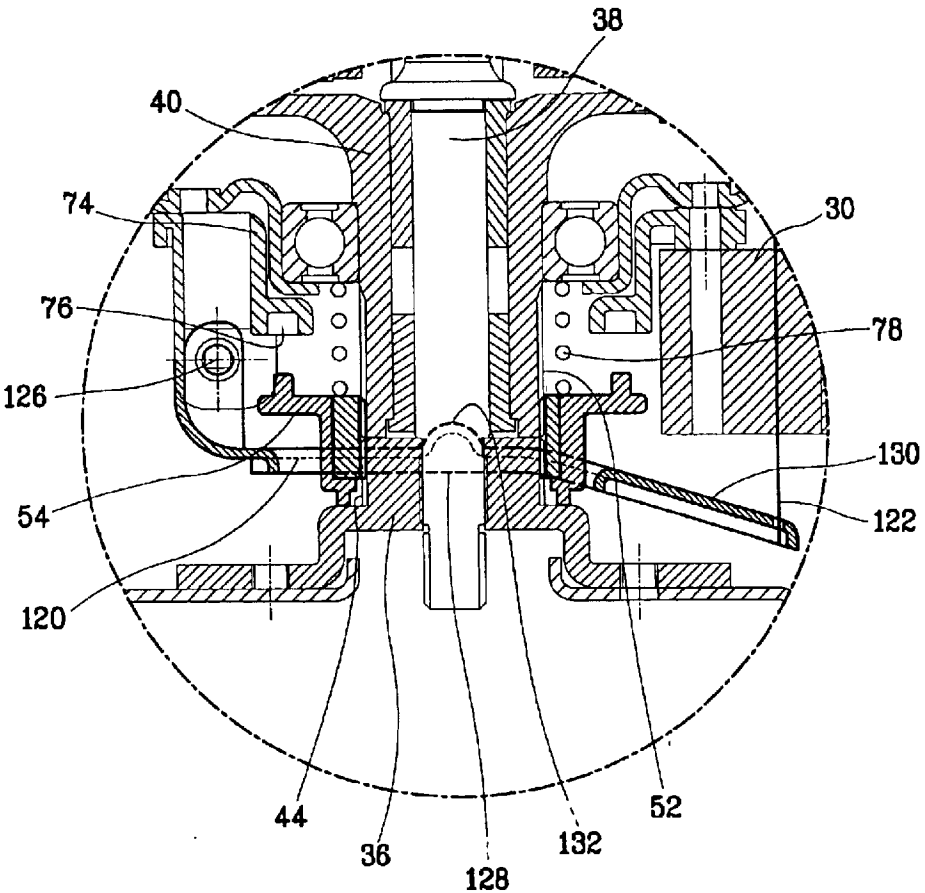
FIG. 10 and FIG. 11 illustrate cross-sectional views for showing operational states of the direct-drive washing machine according to the second embodiment of the present invention.
Figure 11:
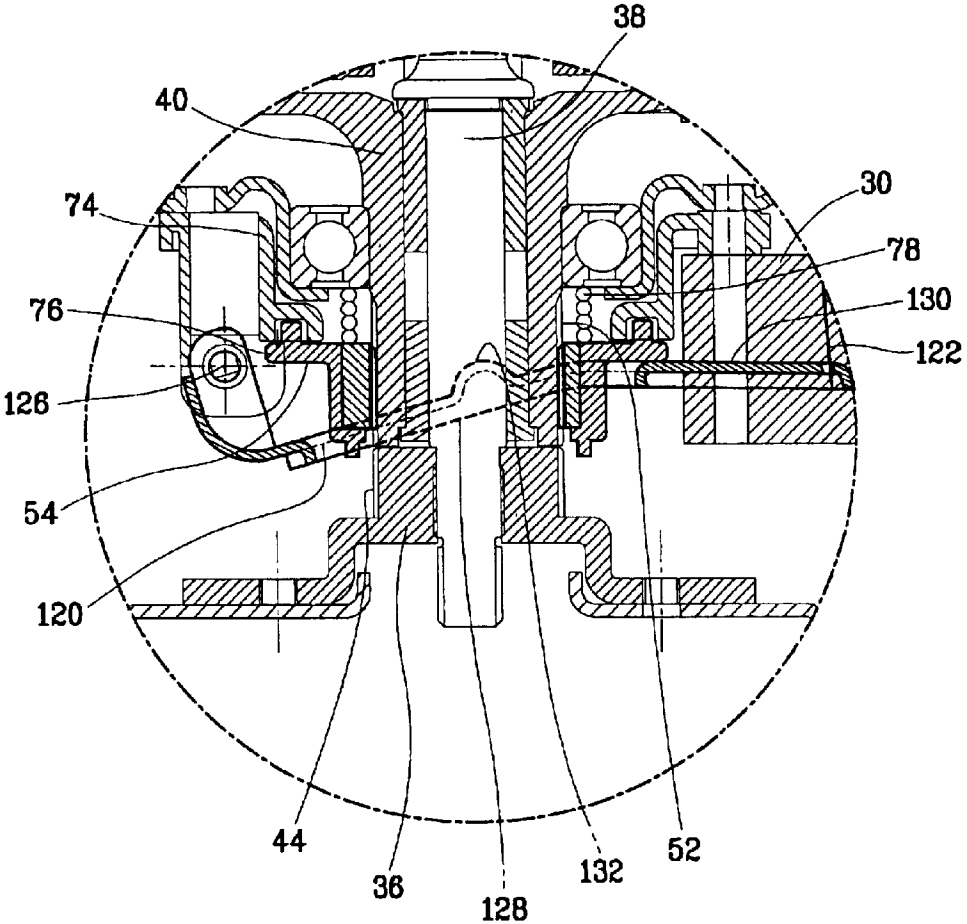

FIG. 10 and FIG. 11 illustrate cross-sectional views for showing operational states of the direct-drive washing machine according to the second embodiment of the present invention.

First, a water supply operation of the washing machine is explained in the following.

For the water supply of the washing machine, the inside of the outer tub 4 is supplied with the washing water while the drive motor 10 and actuator 124 are turned off. Namely, if the actuator 124 is turned off, the sleeve 54 descends by a tensile elastic force of the first spring 78, a compressive elastic force, and its own weight of the second spring 86 so as to gear with the gear teeth 52 and 44 of the second rotating shaft 40 and rotor bushing 36.

After the completion of the water supply operation, a washing operation is carried out.

On the washing operation, it is selected whether the pulsator 8 is revolved only or both of the pulsator 8 and inner tub 6 are revolved under washing conditions such as laundry contamination, laundry quantity, laundry state, and the like.

In this case, if the laundry contamination is severe and the laundry quantity is overloaded, the pulsator 8 is revolved only, of which explanation follows in detail.

When the pulsator 8 is revolved only, the drive motor 10 and actuator 124 are turned on. Once the drive motor 10 is turned on, the rotor 32 starts to revolve by the interaction between the rotor 32 and stator 30. And, the rotor housing 34 fixed to the rotor 32 revolves to revolve the rotor bushing 36 connected to the rotor housing 34. Then, the first rotating shaft 38 coupled with the rotor bushing 36 by spline rotates so as to rotate the pulsator shaft 28 connected to the first rotating shaft 38 through the connecting device rotates. Hence, the pulsator 8 is revolved so as to carry out a cleaning process.

As the actuator 124 is turned on so that the clutch device 14 is actuated by the clutch operating device to push the sleeve 54 upward, the connection between the rotor bushing 36 and second rotating shaft 40 is cut off as well as the second rotating shaft 40 becomes locked. Therefore, the inner tub 6 maintains a still state.

Operation of the clutch operating device is as follows. As the actuator 124 is driven to rotate the pulley 134, the wire 122 connected to the pulley 134 is wound on the pulley 134. The wire connecting part 130 of the operating lever 120 connected to the wire 122 then moves upward. And, the operating lever 120 revolves centering around the hinge hole 126 so that the lifting part 128 is lifted upward to move the sleeve 54 upward.

In this case, as the contact protrusion 132 protruding from the upper face of the lifting part 128 is contacted with the sleeve 54, the contact area therebetween is minimized so as not to interrupt the revolution of the sleeve 54.

As the sleeve 54 moves upward so as to be separated from the gear teeth 44 of the rotor bushing 36, the power transmission from the rotor bushing 36 to the second rotating shaft 40 is cut off. And, the locking lugs 72 formed at the upper face of the sleeve 54 are inserted into the locking recesses 76 at the lower face of the locking bracket 74 so as to lock the second rotating shaft 40. The inner tub shaft 24 connected to the second rotating shaft 40 through the housing 56 then becomes still and the inner tub 6 connected to the inner tub shaft 24 is held still.

Next, when the laundry contamination is low, the laundry quantity is excessive, or the laundry is made of weak fabric, the pulsator 8 and inner tub 6 are revolved simultaneously. Operation of the pulsator 8 and inner tub 6 which are revolving simultaneously is the same of the first embodiment of the present invention, thereby being skipped in this description.

Accordingly, the above-constituted and above-operating direct-drive washing machine according to the present invention has the following effects or advantages.

When the laundry contamination is severe and the laundry quantity is excessive, the actuator is turned on so as to lock the inner tub as well as transfer the turning power of the drive motor to the pulsator only. When the laundry contamination is low, the laundry quantity is excessive, or the laundry is made of weak fabric, the actuator is turned off so as to revolve the pulsator and inner tub simultaneously so as to optimize the condition of washing the laundry as well as improve a washing efficiency.

Moreover, as the drive motor revolves the pulsator if necessary only, thereby reducing the load of the drive motor to maximize an energy efficiency.

Besides, as the locking function of stopping the revolution of the inner tub us carried out simultaneously by both of the locking means installed at the sleeve and the brake assembly, the locking of the inner tub is carried out more perfectly.

Furthermore, the clutch operating device is equipped with the buffer device. When the locking hugs of the sleeve fail to be inserted in the locking recesses of the locking bracket precisely during the turned-on actuator, the load working on the operating lever is reduced so as to prevent the damage and deflection of the operating lever.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A direct-drive washing machine comprising:

an outer tub placed inside a case so as to keep a washing water in store;

an inner tub installed inside the outer tub to revolve wherein that a cleaning of a laundry is carried out in the inner tub;

a pulsator installed inside the inner tub so as to revolve relatively to the inner tub;

a pulsator shaft connected to the pulsator;

a drive motor installed under the outer tub so as to revolve the pulsator and inner tub;

a rotor housing, a rotor of the driving motor being connected to the rotor housing;

a first rotating shaft connected directly between the drive motor and pulsator so as to transfer a drive power of the drive motor to the pulsator directly;

a second rotating shaft installed between the drive motor and the inner tub so as to selectively transfer the drive power of the drive motor to the inner tub, the second rotating shaft having near teeth at a lower end of the second rotating shaft in a circumferential direction;

an inner tub shaft connected to an upper end of the second rotating shaft through a connecting device being located between an upper side of the first rotating shaft and the pulsator shaft;

a clutch installed between the second rotating shaft and drive motor so as to selectively transfer the drive power of the drive motor to the inner tub, the clutch including a rotor bushing being fixed in a circumferential direction of the rotor housing and having near teeth at an outer circumference face, and a sleeve gearing between the near teeth of the rotor bushing and the gear teeth of the second rotating shaft; and a clutch operating device, the sleeve being movable upward and downward in accordance with operation of the clutch operating device to connect the rotor bushing to the second rotating shaft or to disconnect the rotor bushing from the second rotating shaft.

2. The direct-drive washing machine of claim 1, wherein the inner tub shaft having a cylindrical shape is connected to a lower side of the inner tub so as to revolve the inner tub, wherein the pulsator shaft is connected to a lower end of the pulsator so as to revolve the pulsator, and wherein the pulsator shaft is inserted inside the inner tub shaft to rotate relatively so as to be connected to the first rotating shaft.

3. The direct-drive washing machine of claim 1, wherein the drive motor is an outer rotor type motor so that the rotor is installed outside a stator.

4. The direct-drive washing machine of claim 2, wherein the connecting device transfers a turning force of the first rotating shaft to the pulsator shaft.

5. The direct-drive washing machine of claim 4, wherein the second rotating shaft has a cylindrical figure in which the first rotating shaft is inserted to rotate relatively.

6. The direct-drive washing machine of claim 4, the connecting device comprising:

a housing connected between the upper end of the second rotating shaft and a lower end of the inner tub shaft and having gear teeth of the housing in a direction of an inner circumference face;

a planetary gear gearing with the gear teeth of the housing and gear teeth formed at an upper side of the first rotating shaft so as to rotate and revolve;

a hub to which an upper end of a hinge shaft supporting the planetary gear to rotate is fixed wherein the pulsator shaft is fixed to a central upper side of the hub; and a support plate supporting a lower end of the hinge shaft.

7. The direct-drive washing machine of claim 5, wherein the clutch further comprises:

a locking device for locking the sleeve not to revolve when the sleeve moves upward, the locking device being formed at an upper side of the sleeve.

8. The direct-drive washing machine of claim 7, the locking device comprising:

a plurality of locking lugs formed at an upper face of the sleeve in a circumferential direction; and a locking bracket having a plurality of locking recesses in which the locking lugs are inserted respectively and fixed to a fixed side of the washing machine.

9. The direct-drive washing machine of claim 7, wherein a first spring is installed at an upper face of the sleeve so as to return the sleeve to an original state.

10. The direct-drive washing machine of claim 7, the clutch operating device comprising:

an operating lever arranged at an outer circumference face of the sleeve so as to slip wherein one side of the operating lever is hinge-connected to a fixed side of the outer tub so as to move the sleeve upward and downward; and an actuator connected to the other end of the operating lever so as to revolve the operating lever.

11. The direct-drive washing machine of claim 10, wherein the operating lever has a vertically bent plate shape, and wherein the operating lever comprises a fork portion at an end of a lower side so as to be inserted in the outer circumference face of the sleeve by sliding, a hinge protrusion at a bent portion so as to be hinge-connected to a fixed side of the outer tub, and a connecting pin at an end of an upper side so as to be connected to the actuator.

12. The direct-drive washing machine of claim 11, wherein a second spring is installed between the inner lateral face of the operating lever and the fixed side of the outer tub so as to return the operating lever to an original state.

13. The direct-drive washing machine of claim 11, wherein a buffer device is installed between the operating lever and the actuator so as to prevent the operating lever from deflection caused by a drive power of the actuator when the sleeve moves upward so that the locking lugs fail to be inserted precisely in the locking recesses.

14. The direct-drive washing machine of claim 13, the buffer device comprising:

a cylinder connected to the connecting pin of the operating lever and having an opening at one side;

a piston inserted in the cylinder so as to move straight and connected to the actuator;

a cap loaded on the opening of the cylinder; and a third spring installed between the cap and cylinder so as to give a predetermined elastic power when the cylinder moves straight.

15. The direct-drive washing machine of claim 7, wherein the clutch operating device comprising:

an operating lever inserted in an outer circumference face of the sleeve to slip wherein one side of the operating lever is hinge-connected to a fixed side of the case;

a wire connected to the other side of the operating lever; a pulley on which the wire is wound; and an actuator revolving the pulley.

16. The direct-drive washing machine of claim 15, the operating lever comprising:

a hinge connecting part at one side so as to be connected to the fixed side of the outer tub to revolve;

a lifting part at a central portion so as to be inserted in the outer circumference face of the sleeve to move the sleeve upward and downward; and a wire connecting part at the other side so as to be connected to the wire.

17. The direct-drive washing machine of claim 16, wherein a plurality of contact protrusions are formed at an upper face of the lifting part of the operating lever so as to minimize a contact area with the sleeve.

18. The direct-drive washing machine of claim 16, wherein the wire connecting part extends from the lifting part to a predetermined length and is inclined in a direction of a lower side at a predetermined angle.

19. The direct-drive washing machine of claim 4, further comprising a brake assembly installed at other circumference of the housing of the connecting device so as to brake the inner tub.

20. The direct-drive washing machine of claim 19, the brake assembly comprising:

a brake lever connected to a drain motor so as to operate in accordance with operation of the drain motor; and a brake band connected to the brake lever so as to be wrapped by an outer circumference face of the connecting device.

21. The direct-drive washing machine of claim 20, wherein the drain motor is a motor operating by first and second steps, wherein a braking of the brake assembly is released when the drain motor operates by the first step, and wherein a drain valve is actuated as well as the braking of the brake assembly is released when the drain motor operates by the second step.

* * * * *